US005499519A

United States Patent [19]

Brunier et al.

[11] Patent Number: 5,499,519

[45] Date of Patent: Mar. 19, 1996

[54] DEVICE FOR SHOT-BLASTING SURFACES INACCESSIBLE BY A STRAIGHT PIPE

[75] Inventors: Régis G. Brunier, Cerny; Dominique J. Cotto, Viry Chatillon; Richard G. A. Joly, Ris Orangis; Stéphane M. Kerneis, Velizy; Michel F. F. Silvestrelli, Bondoufle, all of France

[73] Assignee: Societe Nationale d'Etude et de Construction de Moteures d'Aviation "SNECMA", Paris, France

[21] Appl. No.: 360,290

[22] Filed: Dec. 21, 1994

[30] Foreign Application Priority Data

Dec. 22, 1993 [FR] France ..... 93 15390

[51] Int. Cl.[6] ..... B24C 1/00

[52] U.S. Cl. ..... 72/53; 451/39

[58] Field of Search ..... 72/53; 29/90.7; 451/38

[56] References Cited

U.S. PATENT DOCUMENTS

| | | | |
|---|---|---|---|
| 3,402,583 | 9/1968 | Burney | 72/53 |
| 3,419,894 | 12/1968 | Burney et al. | 72/53 |
| 3,545,996 | 12/1970 | Duncan | 72/53 |
| 4,084,357 | 4/1978 | Moses . | |
| 5,204,826 | 4/1993 | Thompson et al. | 72/53 |
| 5,367,762 | 11/1994 | Thompson | 72/53 |

FOREIGN PATENT DOCUMENTS

| | | | |
|---|---|---|---|
| 0438837 | 7/1991 | European Pat. Off. . | |
| 9207924 | 10/1992 | Germany . | |
| 0642058 | 1/1979 | U.S.S.R. | 72/53 |
| 2159069 | 11/1985 | United Kingdom . | |
| 2228435 | 8/1990 | United Kingdom . | |

*Primary Examiner*—David Jones

*Attorney, Agent, or Firm*—Oblon, Spivak, McClelland, Maier & Neustadt

[57] ABSTRACT

A shot blasting device is provided for shot-blasting surfaces, particularly of a turbo aero engine, which are inaccessable by a straight pipe. The device includes a shot-blasting pipe which is suitably shaped for entering cavities to be shot blasted. The shot-blasting pipe extends from a rotor where the shot is directly deposited. A column affixes pressures pipes to the rotor and shot-blasting pipe to apply compressed air to the shot and eject the shot out of the rotor and through the shot-blasting pipe.

9 Claims, 5 Drawing Sheets

DEVICE FOR SHOT-BLASTING SURFACES INACCESSIBLE BY A STRAIGHT PIPE

FIELD OF THE INVENTION

The invention concerns the mechanical shot-blasting of surfaces for which access is difficult, such as the internal cavities of a container an object having a relatively complex shape. The invention is more particlarly applicable to the final treatment of surfaces inside a turbo aero engine rotor.

BACKGROUND OF THE INVENTION

When manufacturing turbo aero engines for aircraft, it has been deemed essential to carry out a prestressed shot-blasting on the internal surfaces of the rotor. This surface treatment is able to reinforce the mechanical and protective capacities of the surfaces in question.

Shot-blasting consists of projecting at high speed metal balls having a diameter of between about 0.2 and 0.6 mm. This hammering makes it possible to obtain the expected treatment of the surfaces.

The rotor of a turbo aero engine internally possesses a large number of radial grooves known as stiffeners which form a large number of internal annular cavities which also need to be shot-blasted. The difficulty of carrying out this operation has compelled turbo aero engine manufacturers to produce these rotors made up of several sections so as to be able to gain access to the internal surfaces to be treated by means of shot-blasting. Accordingly, the structure of the rotor lacks homogeneity.

The main object of the invention is to be able to produce a turbo aero engine rotor formed of a single piece whilst allowing for the shot-blasting of all the internal surfaces needing to be treated by this method.

The shot-blasting technique consists of projecting at high speed metallic balls with the aid of one or several high pressure compressed air sources. The balls are thus carried in pipes ending at a terminal projection nozzle. It can be readily understood that the least change of direction on the passage of the flows of balls propelled at high pressure inside the pipe constitutes a significant loss of head and power. The efficiency of the shot-blasting installation is thus dependent on pitfalls of this type. Now, the internal cavities of a turbo aero engine rotor are inaccessible by a straight pipe. In fact, they are indeed not visible. They are only accessible by the central pipe of the rotor where each of these cavities opens onto. In other words, the internal cavities of a turbo aero engine rotor are virtually inaccessible to shot-blasting having sufficient power.

Secondly, an excess pressure shot-blasting installation includes:

- a shot tank or shot feed means;
- means for propelling this shot under pressure, such as compressed air means;
- one or several shot-blasting pipes for bringing the shot under pressure to a projection nozzle, and
- the projection nozzle in question being placed at the end of the pipe.

The shot-blasting pipe(s) thus need to comprise sudden changes of direction. The same applies for the projection nozzle which may be brought to be provided with a deviation surface known as a projection anvil according to the position and orientation of the surfaces to be treated.

SUMMARY OF THE INVENTION

The main object of the invention is to provide a shot-blasting device via the projection of shot under pressure of surfaces inaccessible by a straight pipe and requiring a sudden change of direction for the shot flow, said device comprising:

- a shot feeding pipe;
- high pressure compressed air means for propelling the shot and connected to the outlet of the feeding pipe;
- at least one shot-blasting pipe so as to bring the shot under pressure close to the surfaces to be shot-blasted and connected to the propulsion device, and
- a projection nozzle placed at the end of the shot-blasting pipe.

According to the invention:

- the shot-blasting pipe is rectilinear;
- the propulsion means include two high pressure compressed air pipes opening on both sides of a right-angle bend or elbow which receives at its inlet the feeding pipe, the sudden change of direction of the shot flow being ensured by this right-angle bend prior to connection with the compressed air pipes so that the propulsion energy is only sent to the shot at the inlet of the rectilinear shot-blasting pipe opening onto the projection nozzle.

So as to facilitate the mounting of the device, the fixing of the shot-blasting pipe to the outlet of the propulsion means is obtained on a sleeve by a lockable/unlockable bayonet fixing device so as to enable this pipe to be quickly dismantled.

The nozzle is fixed temporarily by means of screwing so as to be able to be changed at will according to the orientation of the surfaces to be shot-blasted.

So as to shot-blast a complete cavity, the sleeve of the propulsion means is mounted rotating in a support and means for driving said sleeve in rotation are provided so as to be able to have the shot blasting pipe and projection nozzle both rotate.

In this latter case, the following are preferably used:

- a vane type turbine having its spin axis merged with the axis of the shot-blasting pipe, and
- a third compressed air pipe opening tangentially with respect to the vertical spin axis opposite the vanes of the turbine so as to have the shot-blasting pipe and projection nozzle rotate in a rotation direction opposing that of the bayonet device. The device may advantageously be completed by an adjusting screw so as to slow down or block rotation of the turbine.

The first two and the third compressed air feeding pipes are preferably kept approximately parallel as far as the propulsion device with the aid of at least one rigid column.

As part of applying this device for shot-blasting the Internal cavities of an essential voluminous element, such as a turbo aero engine rotor, the device of the invention includes a foot secured to a displacement spindle integral with a shot-blasting machine on the horizontal rotating plate on which the piece to be shot-blasted is fixed so that the shot-blasting pipe is located horizontally introduced into an internal toric space of the turbo aero engine rotor to be shot-blasted.

BRIEF DESCRIPTION OF THE DRAWINGS

The invention and its various technical characteristics shall be more readily understood from a reading of the following description with reference to the accompanying drawings which respectively represent.

DETAILED DESCRIPTION OF THE PREFERRED EMBODIMENTS

Figure 1:
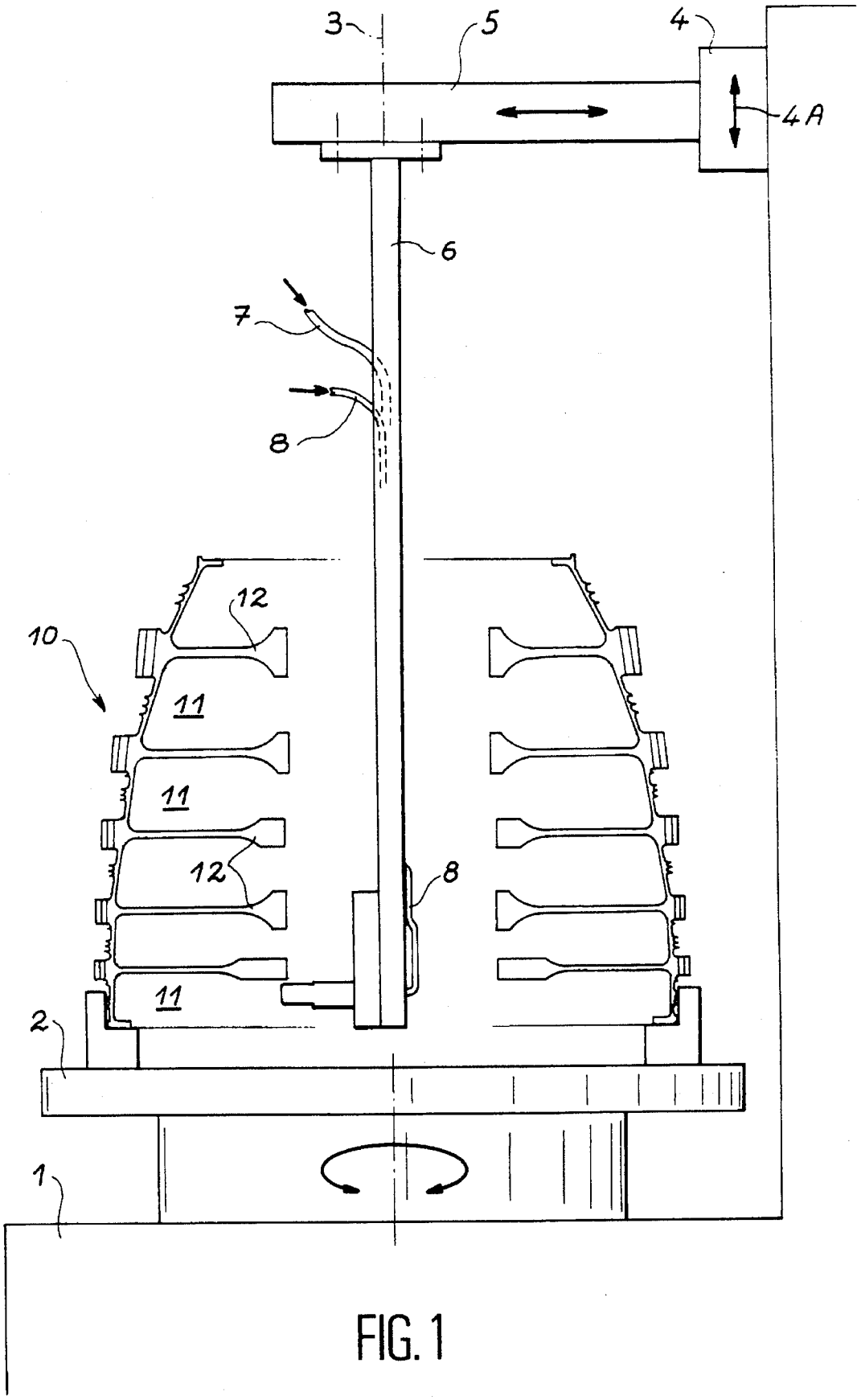
FIG. 1 is a frontal view of the device of the invention and installed on a shot-blasting machine for shot-blasting a turbo aero engine rotor.

FIG. 1 shows a turbo aero engine rotor 10 mounted on the rotating horizontal plate 2 of a shot-blasting machine 1. This rotor 10 is thus driven with a movement of rotation around a vertical axis 3 of the shot-blasting machine with the aim of making all the internal surfaces of the rotor 10 undergo the shot-blasting treatment. In fact, it is possible to distinguish on FIG. 1 radial ribs 12 positioned horizontally inside the rotor 10. They constitute stiffeners essential for the mechanical behaviour of the rotor 10. They delimit internal cavities 11 whose walls are to be shot-blasted. These cavities 11 are directly inaccessible and any element needing to function inside the latter needs to form an elbow so as to be able to gain access to it.

To this effect, the shot-blasting device of the invention is equipped with a foot 4 supporting a horizontal bracket 5. This foot 4 is secured to a displacement axis 4A of the shot-blasting machine 1. It enables the shot-blasting system to be installed coaxially to the vertical axis 3 of the shot-blasting machine 1.

The system of the invention has been symbolized by a vertical column 6 fixed to the bracket 5, the feed pipes of the shot-blasting device being introduced into said column. A first shot feeding pipe 7 is shown, as well as one of the compressed air feed pipes 8.

The operational portion of the shot-blasting device of the invention is symbolized by the lower end of the column 6 supporting a shot-blasting pipe 9 directed towards the inside of a cavity 11. A rotation of the horizontal plate 2 bearing the rotor 10 with respect to this shot-blasting pipe 9 around the vertical axis 3 is able to project inside a cavity 11 the shot over 360° and thus treat this complete annular cavity 11, followed by an additional movement of rotation of the shot-blasting pipe 9 around its horizontal axis, as indicated subsequently.

Figure 2:
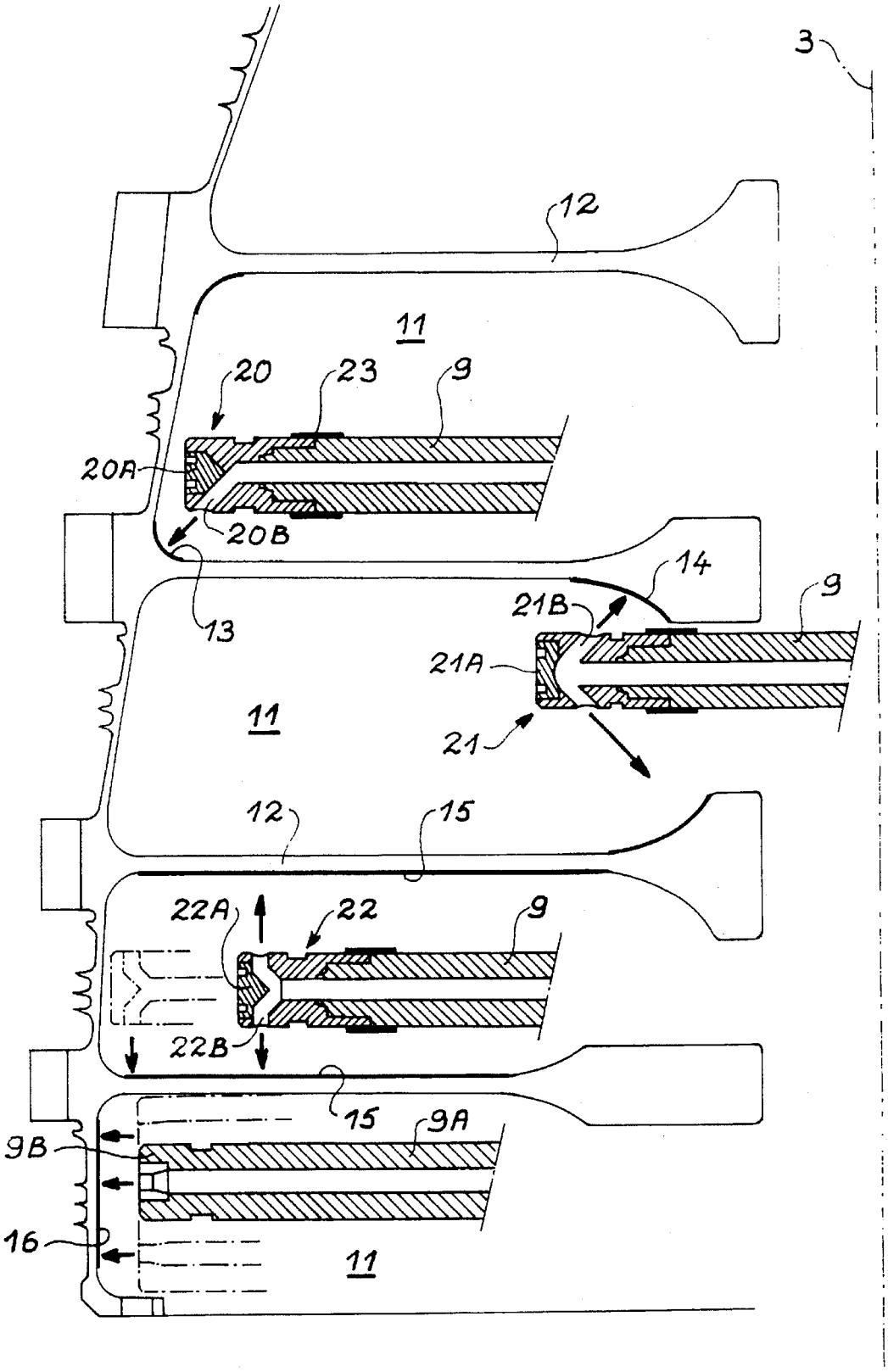
FIG. 2 is a sectional view of the use of several different nozzles with the device of the invention whose application is shown on FIG. 1.

With reference to FIG. 2, which shows a half-section of the rotor 10 of FIG. 1, various shot projection nozzles are used. In fact, having regard to the fact that each cavity 11 has a particular internal shape and made up of a large number of surfaces, it is essential to use different projection nozzles. In the upper cavity 11, a first nozzle 20 is used to project the shot in the corners 13 distanced from the axis 3. This first nozzle 20 has an anvil 20A equipped with a slanted surface so as to deviate the shot jet in cooperation with a slanted pipe 20B of this nozzle 20.

Similarly, in the second cavity 11, a second anvil 21 has been shown mounted on the shot-blasting pipe 9 so as to treat the nearby corners of the axis 3 of the cavity 11. In order to achieve this, an anvil 21A differing from the first one 20A is used. In fact, it possesses a convex surface enabling the shot to be pushed back towards the corners 14 with the aid of at least one pipe 20B slanted in the direction of these corners 14 close to the axis 3. The efficiency of this anvil is less than that of the preceding one, having regard to the fact of the sudden accentuated change of direction of the shot flow which moreover consumes a large amount of energy.

In the third cavity 11, a third projection nozzle 22 has been shown with two lateral pipes 22B to project the shot perpendicular to the lateral surfaces 15 of this cavity 11. Moreover, it uses an anvil 22A cooperating with the two lateral pipes 22B.

The extreme position of this third projection nozzle 22, symbolized by the dot-and-dash lines, diagrammatizes the use of shot-blasting pipes 9 having different lengths so as to allow shot to be projected over the entire internal lateral surface 15 of the cavities 11.

The internal cavity 11 is shown with a shot-blasting pipe 9A ended by a nozzle-shaped portion 9B enabling the flow of shot to be projected without deviating. It allows the extreme surface 16 of the cavity 11 to be treated.

The projection nozzles 20, 21 and 22 are mounted temporarily by screwing around the shot-blasting pipe 9. This fixing may be protected by a sleeve 23.

Figure 3:
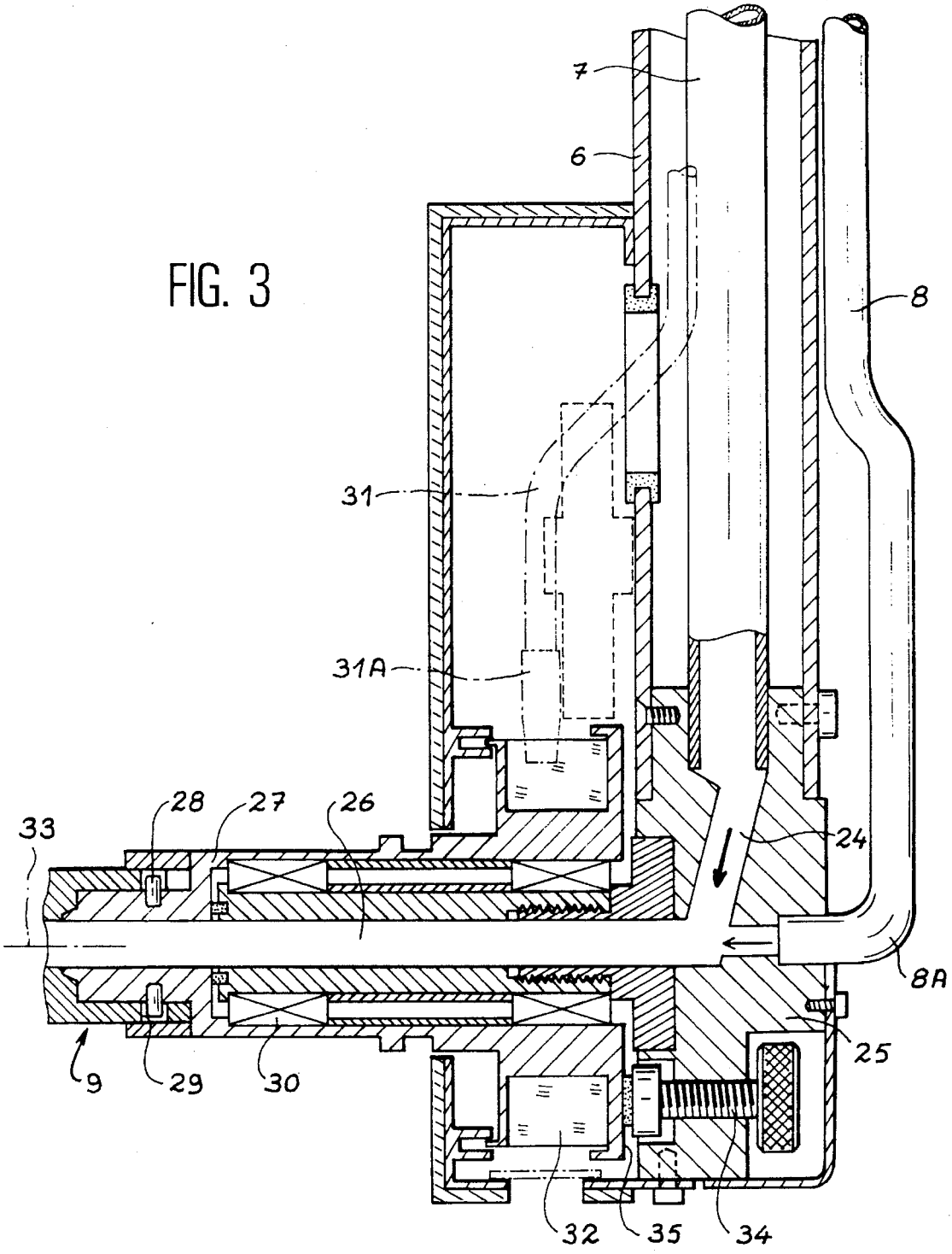
FIG. 3 is a sectional view of the propulsion means of the device of the invention.

With reference to FIG. 3, the shot propulsion means are formed of a device which propels the shot in a direction orientated coaxially to that of the inside of the shot-blasting pipe 9.

In fact, the shot is brought by a feed pipe 7 shown vertical and coaxial on FIG. 1 to the vertical axis 3 of the plate 2 of the shot-blasting machine 1. It shall then be projected horizontally with respect to FIG. 3. Accordingly, it undergoes a change of direction which is situated in an elbow 24 inside a body 25.

One of the two compressed air feed pipes 8 for propelling the shot is shown on the right portion of the figure. It is brought parallel to the shot feed pipe 7 but ends by an elbow 8A opening at the level of the elbow 24 of the body 25 in the extension of the internal pipe 26 placed at the outlet of the elbow 24.

Owing to this, the compressed air projects at high speed the shot falling from the feed pipe 7 via the elbow 24 in the direction of the shot-blasting pipe 9. In this way, the energy sent by the gas under high pressure reaches the shot once the latter has traversed the change of direction mainly constituted by the elbow 24 of the body 25. This energy is thus fully sent to the shot penetrating into the shot-blasting pipe 9 ended by the projection nozzle.

Figure 4:
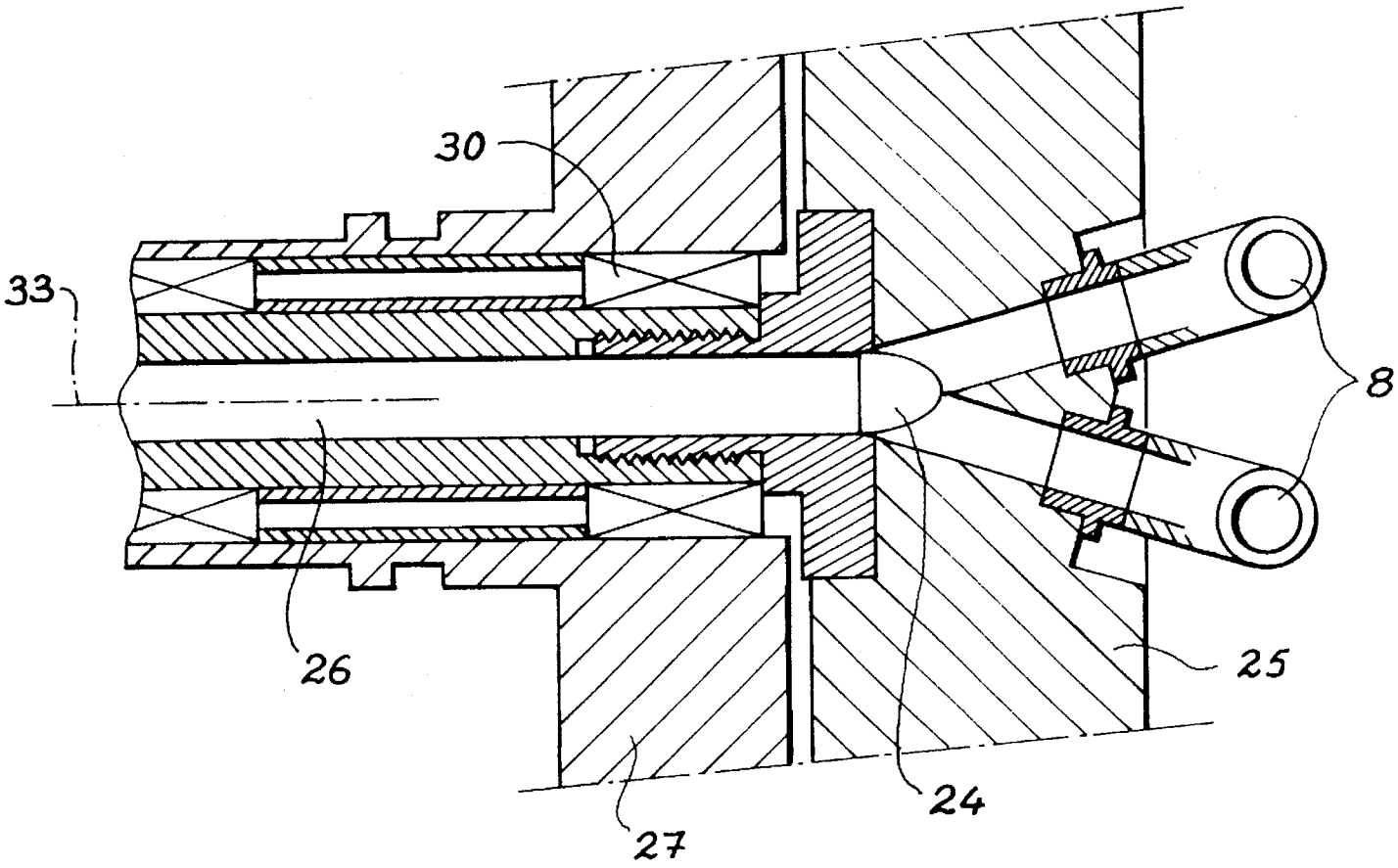
FIG. 4 is a partial side view of details of the propulsion means of the device of the invention.

The arrival of the propulsion compressed air at the outlet of the elbow 24 is also explained by referring to FIG. 4 showing a transverse cutaway view of these elements. Two high pressure compressed air feed pipes 8 have been shown. Their routing is parallel to the column 6 of FIG. 3. They join together inside the support 25 at the level of the outlet of the elbow 24. The shot is thus picked up both below and on each side by the propulsion energy of the high pressure compressed air. It is therefore sent into the internal pipe 26 of the sleeve 27 and then into the shot-blasting pipe 9.

The shot-blasting pipe 9 is secured to the body 25 by means of a sleeve 27. This fixing is preferably effected by a bayonet system diagrammatized by two dog points 28 fixed in this sleeve 27 and going past a groove 29 of the pipe 9. In other words, the fixing of the shot-blasting pipe 9 requires the introduction of two grooves 29 each disposed around a dog point 28 and the rotation of the shot-blasting pipe 9 around its vertical axis until the unit stops in a final fixing position.

Thus, the shot-blasting pipe 9 is mounted and dismantled easily and quickly. This makes it possible to rapidly change the shot-blasting pipes 9 so as to use shot-blasting pipes having different lengths. In fact, as shown on FIG. 2, the cavities 11 are relatively radially wide and require several radial positions of projection nozzles and thus several shot-blasting pipes.

As shown on FIG. 3, the sleeve 27 is mounted rotating on the support 25 with the aid of roller bearings 30. Owing to this, this shot-blasting pipe 9 is thus mounted rotating. As a result, all the projection nozzles are able to eject the shot in all directions around the horizontal axis 33 of the shot-blasting pipe 9.

The driving in rotation of the sleeve 27/shot-blasting pipe 9/projection nozzle unit can be effected with the aid of a third additional compressed pipe 31. The outgoing end 31A of this third pipe is then positioned opposite the vanes 32 of a turbine integral with the sleeve 27.

Figure 5:
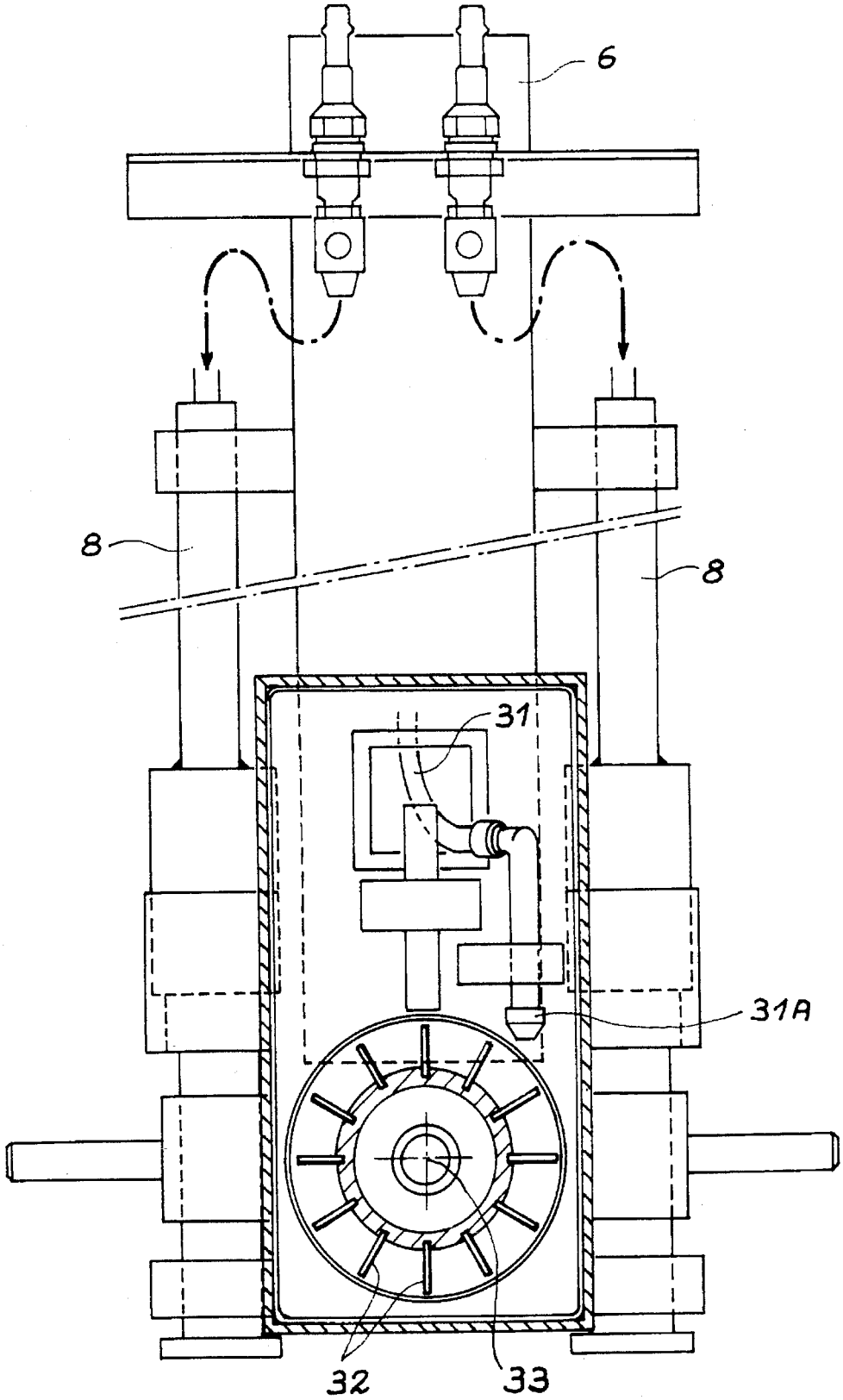
FIG. 5 is a top view of the means for driving in rotation the device of the invention.

FIG. 5 shows in more detail these means for rotating the shot-blasting pipe 9. In fact, this figure shows the vanes 32 of the turbine and the end 31A of the third compressed air pipe 31. It also shows by way of indication the first two compressed air pipes 8 bringing propulsion power to the shot.

The outgoing end 31A of the third compressed air pipe 31 is offset with respect to the axis of symmetry of the system and at the same time with respect to the spin axis 33 of the turbine. This axis is also the spin axis of the shot-blasting pipe 9 and sleeve 27 of FIG. 3. It should also be mentioned that the direction of rotation of the turbine is opposite the direction of mounting of the shot-blasting pipe 9 in the sleeve 27. This makes it possible to avoid any unexpected dismantling of the shot-blasting pipes 9 and ensure they are kept in this position.

FIG. 5 also shows the column 6 used to support the feed pipes 8, 31.

With reference again to FIG. 3, a pressure screw 34 may be used to act via screwing on the speed of rotation of the turbine. In fact, the screw may be brought to rub against a radial surface 35 of the turbine. Thus, it is possible to block the rotation of the sleeve 27 with the aim of mounting or dismantling a shot-blasting pipe. It is also possible to use this adjustment screw 34 to vary the rotational speed of the turbine.

The installation needed to apply this system preferably requires the use of an additional air intake so as to blow the shot which accumulates inside the cavities to be treated. This means that it is moreover possible to suck up this shot for carrying out this evacuation.

The treatment by shot-blasting of all the internal surfaces of a turbo aero engine rotor formed of a single piece is thus possible by using a shot-blasting machine with a horizontal rotary plate and the device of the invention. In addition, a large number of shot-blasting pipes 9 of different lengths to be changed and the use of different projection nozzles are required to machine a single rotor. However, the time gained for carrying out this operation, the surface treatment quality obtained and the homogeneous mechanical structure of the rotor formed of a single piece constitute considerable advantages compared with the preceding methods for producing these turbo aero engine rotors.

What is claimed is:

1. A shot projection apparatus using shot for shot-blasting under pressure surfaces inaccessible by a straight pipe and requiring the shot to change direction to shot-blast the surfaces, comprising:

a shot feed pipe;

propulsion means fixed to an outlet of the shot feed pipe for providing high pressure compressed air;

a shot-blasting pipe to direct the shot under pressure of said propulsion means to surfaces to be shot-blasted, said shot-blasting pipe being rectilinear and fixed to the propulsion means;

a projection nozzle placed at an end of the shot-blasting pipe where the shot projects from the shot-blasting pipe;

said propulsion means including first and second high pressure compressed air pipes entering into an elbow at a first end and receiving the shot feed pipe at a second end, a sudden change of direction for the shot flow taking place in the elbow so that propulsion energy from the high pressure compressed air is transferred only to the shot at the projection nozzle; and a sleeve and bayonet fixing device for lockably attaching the shot-blasting pipe to an outlet of the propulsion means such that the shot-blasting pipe can be disengaged from the propulsion means.

2. The apparatus according to claim 1, wherein the projection nozzle is screwed to the shot-blasting pipe and can be easily changed.

3. The apparatus according to claim 1, wherein the sleeve is rotatably mounted in a support of the propulsion means and wherein a rotary drive means is used to make the sleeve rotate around a spin axis, coaxial with that of the shot-blasting pipe.

4. The apparatus according to claim 3, wherein the rotary drive means include:

a vane turbine with a vertical spin axis secured to the sleeve; and a third high pressure compressed air pipe having an opening pointed in a tangential direction with respect to the vertical spin axis of the vane turbine and situated opposite vanes of the turbine for causing the shot-blasting pipe and projection nozzle to rotate in a direction of rotation opposing a fixing direction of the bayonet device.

5. The apparatus according to claim 4, further comprising:

an adjusting screw used to slow down and block rotation of the vane turbine.

6. The apparatus according to claim 1, further comprising:

a third high pressure compressed air pipe; and a rigid column for fixing the shot feed pipe, the first and second high pressure compressed air pipes and the third high pressure compressed air pipe approximately parallel.

7. The apparatus according to claim 6, further comprising:

a foot secured to a displacement axis of a shot-blasting machine with a horizontal rotary plate supporting a turbo aero engine rotor to be shot-blasted so that the shot-blasting pipe is located horizontally and can be introduced into an internal toric cavity of a rotor.

8. A shot projection apparatus using shot for shot-blasting under pressure surfaces inaccessible by a straight pipe and requiring the shot to change direction to shot-blast the surfaces, comprising:

a shot feed pipe;

propulsion means fixed to an outlet of the shot feed pipe for providing high pressure compressed air;

a shot-blasting pipe to direct the shot under pressure of said propulsion means to surfaces to be shot-blasted, said shot-blasting pipe being rectilinear and fixed to the propulsion means;

a projection nozzle placed at an end of the shot-blasting pipe where the shot projects from the shot-blasting pipe;

ssaid propulsion means including first and second high pressure compressed air pipes entering into an elbow at first end and receiving the shot feed pipe at a second end, a sudden change of direction for the shot flow taking place in the elbow so that propulsion energy from the high pressure compressed air is transferred only to the shot at the projection nozzle;

a third high pressure compressed air pipe; and a rigid column for fixing the shot feed pipe, the first and second high pressure compressed air pipes and the third high pressure compressed air pipe approximately parallel.

9. The apparatus according to claim 8, further comprising:

a foot secured to a displacement axis of a shot-blasting machine with a horizontal rotary plate supporting a turbo aero engine rotor to be shot-blasted so that the shot-blasting pipe is located horizontally and can be introduced into an internal toric cavity of a rotor.

* * * * *